US005660173A

United States Patent [19]

Newton

[11] Patent Number: 5,660,173

[45] Date of Patent: Aug. 26, 1997

[54] FRUSTUM LAYERED CANISTER

[75] Inventor: Richard A. Newton, Bad Vilbel, Germany

[73] Assignee: The United States of America as represented by the Secretary of the Army, Washington, D.C.

[21] Appl. No.: 175,462

[22] Filed: Dec. 30, 1993

[51] Int. Cl.[6] ..... A62B 7/10

[52] U.S. Cl. ..... 128/206.17; 128/205.27; 128/205.28; 128/205.29

[58] Field of Search ..... 128/205.27, 205.28, 128/205.29, 206.17, 206.12

[56] References Cited

U.S. PATENT DOCUMENTS

| | | | |
|---|---|---|---|
| 1,654,925 | 1/1928 | Drager | 128/205.28 |
| 1,789,262 | 1/1931 | Monro et al. | 128/206.17 |
| 1,963,874 | 6/1934 | Stampe | 128/206.17 |
| 2,195,563 | 4/1940 | Fils | 128/206.17 |
| 3,566,867 | 3/1971 | Dryden | 128/205.28 |
| 4,098,270 | 7/1978 | Dolby | 128/206.12 |
| 5,400,780 | 3/1995 | Nishino | 128/205.28 |
| 5,492,882 | 2/1996 | Doughty | 128/205.28 |

FOREIGN PATENT DOCUMENTS

| | | | |
|---|---|---|---|
| 238463 | 9/1987 | European Pat. Off. | 128/205.28 |

*Primary Examiner*—Jennifer Bahr
*Assistant Examiner*—William J. Deane, Jr.
*Attorney, Agent, or Firm*—Saul Elbaum; Edward L. Stolarun

[57] ABSTRACT

A cylindrical canister or respirator filter for use in conjunction with a gas mask for individual protection against respiratory hazards, including a frustum shaped carbon bed and a layered array of different size carbon particles in the carbon bed. The interior wall of the canister or respirator is dimpled to afford greater packing density of the carbon particles, and the carbon particles have hollow rectangular or cylindrical extrudate shapes. A chromium-free carbon is used to reduce health risks to users.

10 Claims, 3 Drawing Sheets

FRUSTUM LAYERED CANISTER

GOVERNMENT INTEREST

The invention described herein may be manufactured, used and licensed by or for the U.S. Government.

BACKGROUND OF THE INVENTION

1. Field of the Invention

The invention described is a design improvement of the cylindrical canister or respirator filter that is used in conjunction with a gas mask for individual protection against respiratory hazards. The canisters are used in military applications to protect soldiers against chemical warfare agents.

In civilian applications, respirators are used to protect workers in environments contaminated with toxic and/or noxious gases or vapors. Presently, military canisters and civilian respirators use a cylindrical geometry for the carbonaceous adsorbent bed.

This invention improves the problem of sacrificing protection time, against chemical and biological warfare agents, for pressure drop, in canister design. Pressure drop, or breathing resistance, is a measure of the difficulty one experiences in breathing through a gas mask canister. The deeper the carbon bed in the canister, the greater the protection against toxic agents. However, as bed depth increases, so too does the pressure drop. In the past, the depth of the carbon bed was shortened, at the expense of protection time, to lower the pressure drop of the canister thus making it easier for the user of the canister to breathe. The problem of maximizing protection, and minimizing pressure drop, has existed since canisters were first designed in World War I to protect soldiers against poison gas attacks.

2. Description of the Prior Art

The old ways of lowering pressure drop used the three techniques listed below.

1. Decrease the depth of the carbon bed.
2. Increase the particle size of the carbon in the bed.
3. Increase the diameter of the carbon bed.

The old ways of increasing protection time used the three techniques listed below.

4. Increasing the depth of the carbon bed.
5. Decrease the particle size of the carbon in the bed.
6. Impregnating the carbon in the canister or respirator bed with reactive chemicals.

The opposing guidance that 1, 2 give in relation to 4, 5 point out the give and take nature of the old ways of solving the conflicting problems of pressure drop and protection. The old ways of solving the problems of pressure drop and protection are unsatisfactory because each has a significant drawback.

Decreasing the bed depth will lower the pressure drop but it will also decrease the protection time against toxic agents for user of the canister or respirator. Increasing the bed depth increases the pressure drop by introducing more resistance for the air stream passing through the carbon bed off the canister. The more carbon particles the air stream must bypass, the greater the resistance to flow and hence, the greater the pressure drop and breathing resistance for the user.

Increasing the diameter of the bed will lower pressure drop. However, greatly increasing the size of the canister may restrict the movements or vision of the user. The velocity in a packed bed is equal to the total flow divided by the cross sectional area throughout which the flows passes.

Velocity=total flow/cross sectional area

Increasing the diameter of the canister lowers pressure drop because it lowers the velocity of the air stream passing through the carbon bed. An air stream with a lower velocity encounters less resistance than an air stream with a higher velocity.

Increasing the particle size of the carbon in the bed will lower the pressure drop, but it will also decrease the internal mass transfer rate. The internal mass transfer rate is a measure of the movement of the adsorbate (that which is to be absorbed i.e. toxic compounds) into the adsorbent (the medium into which the adsorbate adsorbs i.e. carbon). It is measured as a mass per unit time. For the purposes of protection against toxic agents or chemicals, the greater the internal mass transfer rate, the better. The internal mass transfer rate of the carbon particle is, among other things, dependent on the distance between the external surface of the particle and the internal adsorption sites in the pores of the carbon particle. The bigger the particle, the greater the distance between the external surface of the particle and the adsorption sites in the pore. The greater the distance, the longer it takes for any adsorbate, such as a toxic agent to move from the exterior of the particle to the adsorption site inside the particle. Hence, a bigger particle size results in a lower internal mass transfer rate, and, in many cases, a shorter protection time for the user of the canister.

SUMMARY OF THE INVENTION

Accordingly, it is an object of the invention to increase the protection time while decreasing the pressure drop in a carbon bed.

Another object of the present invention is to reduce the premature breakthrough of noxious compounds in gas mask canisters and respirator filters.

Still another object of the present invention is to provide an improved filtration chamber configuration.

Yet another object of the present invention is to increase the packing density of carbon beds.

The present invention is summarized in a filtration system for removing undesirable constituents from a fluid including a housing having a filtration chamber and an upstream port for receiving the fluid to be filtered and a downstream port for passing the filtered fluid, a filter means within the filtration chamber including a packed array of particles, the particles having the capability to remove one or more undesirable constituents from the fluid to be filtered, and the configuration of the filter bed being such as to expose a greater cross section area of particles to the fluid at an upstream section of the filter bed, and a smaller cross section area of particles to the fluid at a downstream section of the filter bed.

Other objects and advantages of the present invention will be more fully apparent from the following description of the preferred embodiment when taken in conjunction with the accompanying drawings.

DESCRIPTION OF THE PREFERRED EMBODIMENT

Figure 1:
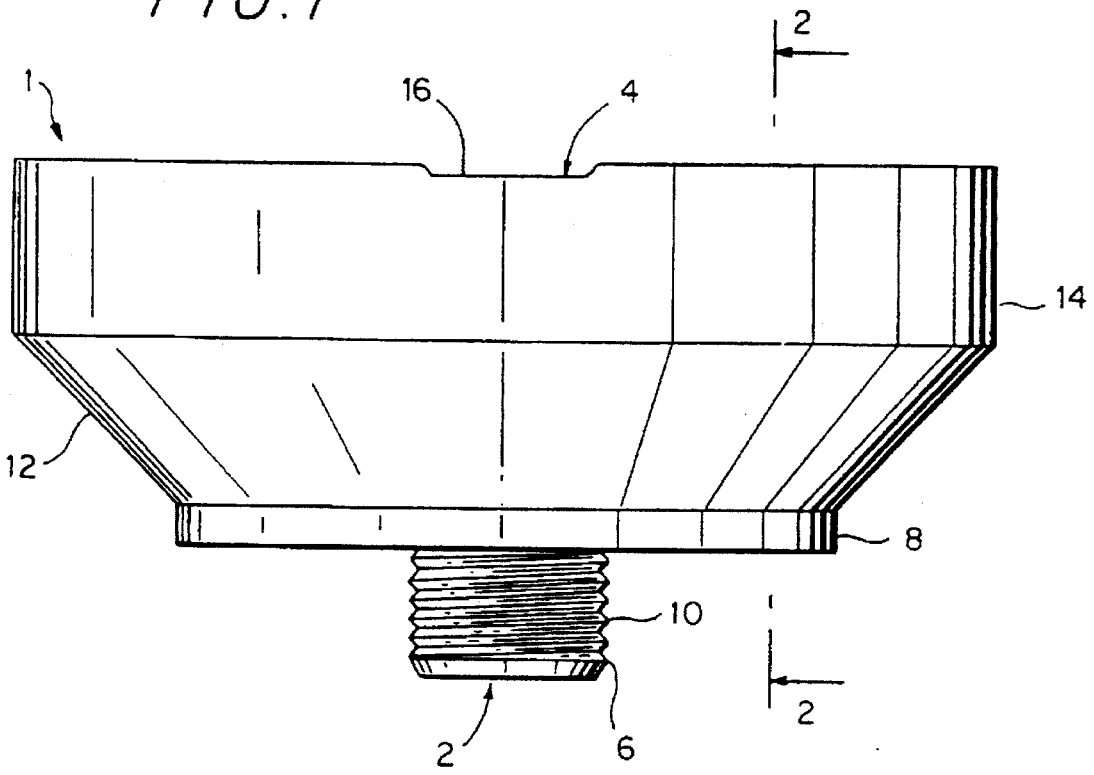
FIG. 1 is a side elevation view of a canister in accordance with the present invention.

Referring to FIG. 1, a canister or respirator filter in accordance with the present invention includes a generally cylindrical or circumferential housing, generally shown at 1, which is opened at opposite ends thereof to form access ports 2, 4 for the passage of air therethrough. Canister housings have typically been made of steel or aluminum and such materials may be likewise be used for housing 1, although the preferable material would be a high strength thermoplastic. For discussion purposes, the access port 4 will be referred to as the upstream or inlet side, and the access port 2 will be referred to as the downstream or outlet side.

The housing 1 is designed to accommodate a plurality of filtration stages therein between the access ports 2, 4 which condition the air for breathing by removing harmful or undesirable components therefrom. The access port 2 is formed by a cylindrical boss 6 which extends from a cylindrical plenum 8 having a larger diameter than that of boss 6. Boss 6 has a hollow construction and includes an externally disposed screw thread 10 intended for connection to an internally threaded receptacle of a gas mask (not shown). For this purpose, the thread 10 would conform to STANAG 4155 NATO (40 millimeter) standards.

An intermediate frustum shaped section 12 of housing 1 is connected between the plenum 8 and a cylindrical section 14 of housing 1. The smaller diameter end of The frustum shaped section 12 has its smaller diameter end connected to the plenum 8, and its larger diameter end connected to a cylindrical shaped enclosure 14. A baffle 16 extends across the cylindrical shaped enclosure 14 at an end thereof opposite to the end connected to the frustum shaped section 12. The cylindrical shaped enclosure 14 and baffle 16 form the access port 4 referred to earlier. Baffle 16 allows passage of the incoming air to be filtered and directs the air evenly across the entire expanse of the access port 4. Baffle 16 includes a circular louver construction to minimize the ingress of water.

Figure 2:
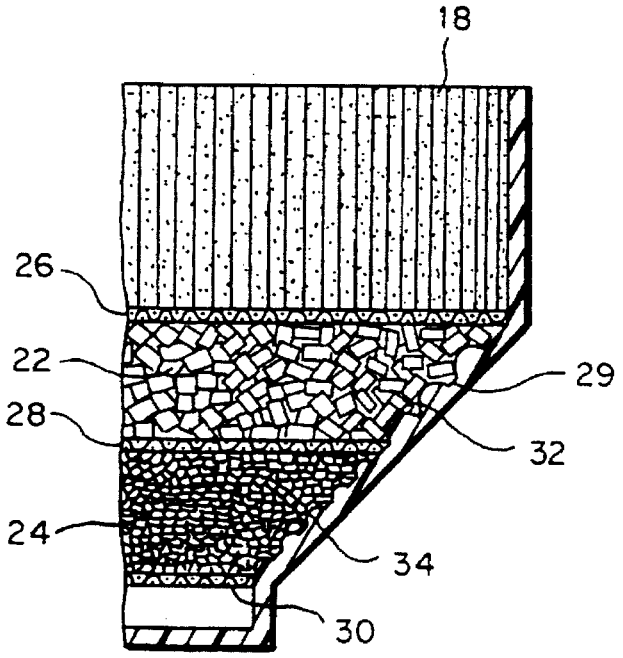
FIG. 2 is an enlarged partial cross section view of the canister of FIG. 1 taken along the line 2—2 of FIG. 1.

As mentioned, the above-described housing 1 contains a plurality of sequentially arrayed filter stages therein for the purpose of removing all harmful and undesirable compounds from incoming air to thereby render it breathable. As shown in FIG. 2, a filter 18 is disposed within the cylindrical shaped enclosure 14 adjacent the baffle 16. The filter 18 fills enclosure 14 and is a high efficiency particulate type which is plicated to achieve maximum surface area for filtration. The particulate filter 18 is preferably made from a high efficiency, water repellant glass fiber paper. The baffle 16 adjacent filter 18 is of conventional design which is constructed to distribute incoming air evenly across the entire expanse of filter 18.

A sequence of two different carbon particle filtration stages, also referred to as carbon beds, 22, 24 are disposed downstream of filter 18 and are positioned within the frustum shaped section 12 of housing 1. The first or upstream carbon bed 22 includes U.S. sieve #12×18 cylindrical ASZM-T carbon particles which serves to lower the pressure drop at this stage. The second or downstream carbon bed 24 includes U.S. sieve #20×30 cylindrical ASZM-T carbon particles. This size carbon particle is selected to allow for increased mass transfer of air therethrough while maintaining adequate health considerations.

A screen 26 is interposed within housing 1 at the juncture of the cylindrical shaped enclosure 14 and the frustum shaped section 12 which serves to separate the carbon bed 22 from the particulate filter 18. The mesh of screen 26 should be of a size to keep the particles of carbon bed 22 in place. Accordingly, a mesh no larger than #20 U.S. sieve (0.841 millimeters) is considered sufficient for this purpose.

In addition, a screen 28 is disposed between and serves to separate the two different size carbon beds 22, 24. The mesh of screen 28 should likewise be of a size to keep the particles of carbon beds 22, 24 in their place. In view of the smaller particle size of carbon bed 24, a mesh no larger than #40 U.S. sieve (0.420 millimeters) is considered sufficient for this purpose. The carbon beds 22, 24 have been designed to have a frustum shaped configuration due to the shape of the frustum shaped section 12 the carbon beds 22, 24 are retained in. All of the screens are preferably made of high strength thermoplastic, but other suitable materials, such as aluminum and steel, might also be used. A dust screen 30 is disposed within housing 1 adjacent the downstream side of carbon bed 24 proximate the plenum 8. Dust screen 30 would have the same mesh size as screen 28 for retaining the particles of carbon bed 24. In addition, dust screen 30 would include a layer of water repellant glass fiber paper, which acts as a trap to prevent carbon dust from exiting the carbon bed 24 to be inhaled by a user.

In addition, the interior wall of the frustum shaped section 12 includes a non-smooth, dimpled surface 29. The dimples are formed of an irregular array of protuberances and depressions in the interior wall which are sized to approximately coincide with the size of the carbon particles adjacent thereto. Since each of the carbon beds 22, 24 has been specified to contain a different size carbon particle, the interior wall will likewise contain two different sizes of dimpling, larger sized dimpling 32 and smaller size dimpling 34, at discrete portions thereof corresponding to the positions of the respective carbon beds 22, 24. In instances where the frustum shaped section 12 thereof is made of malleable material, such as aluminum or steel, the dimpling could be achieved during a rolling process on the material. In instances where the housing 1 is made of a plastic or the like material which can be molded, such as by injection molding, the dimpling could be achieved by being incorporated in the shape of the mold.

In the construction of the canister, the particulate filter 18 is made such that it is attached to the cylindrical shaped enclosure 14, and together these components form a lid to the canister. This lid is then joined to the frustum shaped section 12 in the course of construction.

Exemplary specifications for the above described canister are set forth below.

| | |
|---|---|
| Total volume of carbon | 201 cm. |
| Volume of #12 × 18 particles | 132 cm. |
| Inlet diameter of #12 × 18 bed | 13 cm. |
| Outlet diameter of #12 × 18 bed | 10.6 cm. |
| Height of #12 × 18 bed | 1.2 cm. |
| Average particle size | 0.132 cm. |
| Volume of #20 × 30 particles | 71 cm. |
| Inlet diameter of #20 × 30 bed | 10.6 cm. |
| Outlet diameter of #23 × 30 bed | 8.4 cm. |
| Height of #20 × 30 bed | 1.0 cm. |
| Average particle size | 0.08 cm. |
| Height of canister | 7.3 cm. |
| Diameter of canister | 13 cm. |
| Calculated pressure drop (@ 32 1 pm using Leva equation for granular carbon) | 0.66 cm. H2O |

The canister is intended to be used as other canisters are typically used in conjunction with a gas mask to protect the wearer against chemical warfare agents. It could also be used to protect individuals working in and around toxic environments such as hazardous waste spills. Once screwed into place on a gas mask having a threaded receptacle accepting the standard NATO thread, air is inhaled normally and is drawn into the housing 1 through the baffle 16 which causes the air to be dispersed across the particulate filter 18. For discussion purposes, the influent air will be assumed to include harmful contaminants. The particulate filter 18 retains solid contaminants and allows the air to pass therethrough to the carbon beds 22, 24 which acts to adsorb the noxious and toxic contaminants present in the air. The air, which is now purified to a degree that it may be respirated, then passes through the dust filter 30 into the plenum 8 and out the access port 2 to the interior of the gas mask.

The canister removes chemical agents such as the nerve agents tabun, sarin, and soman; blood agents hydrogen cyanide, arsine, and dyanogen chloride; chocking agents phosgene and diphosgene; blister agents nitrogen mustard and lewisite; vomiting agents adamsite, diphenylcyanoarsine, and diphenylchloroarsine; and lacrimating agent chloropicrin. The canister also removes organic vapors with moderate vapor pressures and acid gasses.

The advantages of this invention are numerous and significant. Each one is directed at a specific problem or limitation well known to the art of filter design. The design improvements are discussed below.

(a) Frustum shaped carbon bed:

The frustum shaped carbon bed has been shown to increase protection time, and decrease the pressure drop, compared to a cylindrically shaped carbon bed, based upon experimentation and testing undertaken at the Edgewood Research, Development and Engineering Center, Edgewood, Md. The frustum shaped canister or respirator will give increased protection at the same pressure drop as any canister now available.

The Edgewood experimentation and testing was carried out on a gas testing apparatus specially designed for this purpose. A feed concentration of 4000 mg/m cyanogen chloride (CK) was used. The volumetric flow rate through the two geometries was 4.34 liters/minute and the relative humidity was 80% at 23° C. Calgon Corporation's ASC lot 1713 carbon was used in the experiments. Prior to testing, the carbon was equilibrated overnight 80% relative humidity and 26° C.

The feed relative humidity was checked with a dewpoint hygrometer. Feed and effluent concentrations were monitored with flame ionization detectors in a gas chromatograph. The feed humidity was checked with a dewpoint hygrometer. The experiments were run at least twice, often on different days, to assure reproducibility.

The bed dimensions and superficial velocities of the frustum and the cylinder used during the testing are set forth below.

Bed Parameters

| | Cylinder | Frustum | |
|---|---|---|---|
| Inlet Diameter (cm) | 3.1 | 4.8 | |
| Out Diameter (cm) | 3.1 | 3.1 | |
| Bed Depth (cm) | 3.0 | 1.8 | |
| | | inlet | outlet |
| Superficial Velocity (cm/sec) at a Volumetric flow rate of 4.34 1/min | 9.6 | 3.9 | 9.6 |
| Cross sectional area (square centimeters) | 7.6 | 18.1 | 7.6 |

The superficial airflow velocity at all locations within the frustum was less than or equal to that of the cylinder. Additionally, the bed depth of the frustum was 40% less than the cylinder. The pressure drop of the carbon bed is a function of the superficial velocity and the bed depth. The superficial velocity is itself a function of the cross sectional area. The resultant pressure drops both calculated via the Leva equation and based upon the experimental results are set forth below.

Pressure Drop (At a flowrate of 4.34 liters/min.)

| | Cylinder | | Frustum | |
|---|---|---|---|---|
| (cm of H20) | Calculated | Experimental | Calculated | Experimental |
| 12 × 30 U.S. Sieve | 1.18 | 1.45 | 0.46 | 0.30 |
| 20 × 30 U.S. Sieve | 2.05 | 2.05 | 0.79 | 0.50 |

The pressure drop (both the calculated and experimental) values of the frustum was shown to be clearly lower than that of the cylinder for both sieve sizes. The effect is so dramatic that a cylindrical bed of 12×30 carbon has a higher pressure drop than a frustum shaped bed with 20×30 sieve carbon. The experimental values agree fairly well with the values calculated from the Leva equation for the cylinder. However, for the frustum the experimental values are substantially lower than the calculated values. This discrepancy indicates that some characteristics of flow passing through the frustum shaped bed appear to provide additional reduction in pressure drop that is not addressed by the Leva equation. Calculation of the pressure drops using the Leva equation was straightforward for the cylinder. However, calculated values for the frustum required some mathematical manipulation as the superficial velocity varies along the length of the bed as the cross section area changes.

The cyanogen chloride (CK) breaktimes for the two geometries using two different particle sizes are set forth below.

CK Breaktimes (minutes)

| Break concentration 8 mg/cubic meter | Cylinder | Frustum |
|---|---|---|
| 12 × 30 | 79 | 87 |
| 20 × 30 | 97 | 117 |

The difference in breaktimes between the frustum and cylinder for the 12×30 carbon is only 8 minutes. However, the difference between the frustum and the cylinder when a 20×30 carbon is used is 20 minutes. Moreover the pressure drop for a 20×30 carbon configured in the frustum geometry is 0.50 cm of H2O. The pressure drop for a 12×30 carbon configured as a cylinder is 1.45 cm of H2O. This means one could use 20×30 particles in a frustum shaped bed and have approximately ⅓ the pressure drop (lower breathing resistance) and 38 minutes longer protection.

Figure 3:
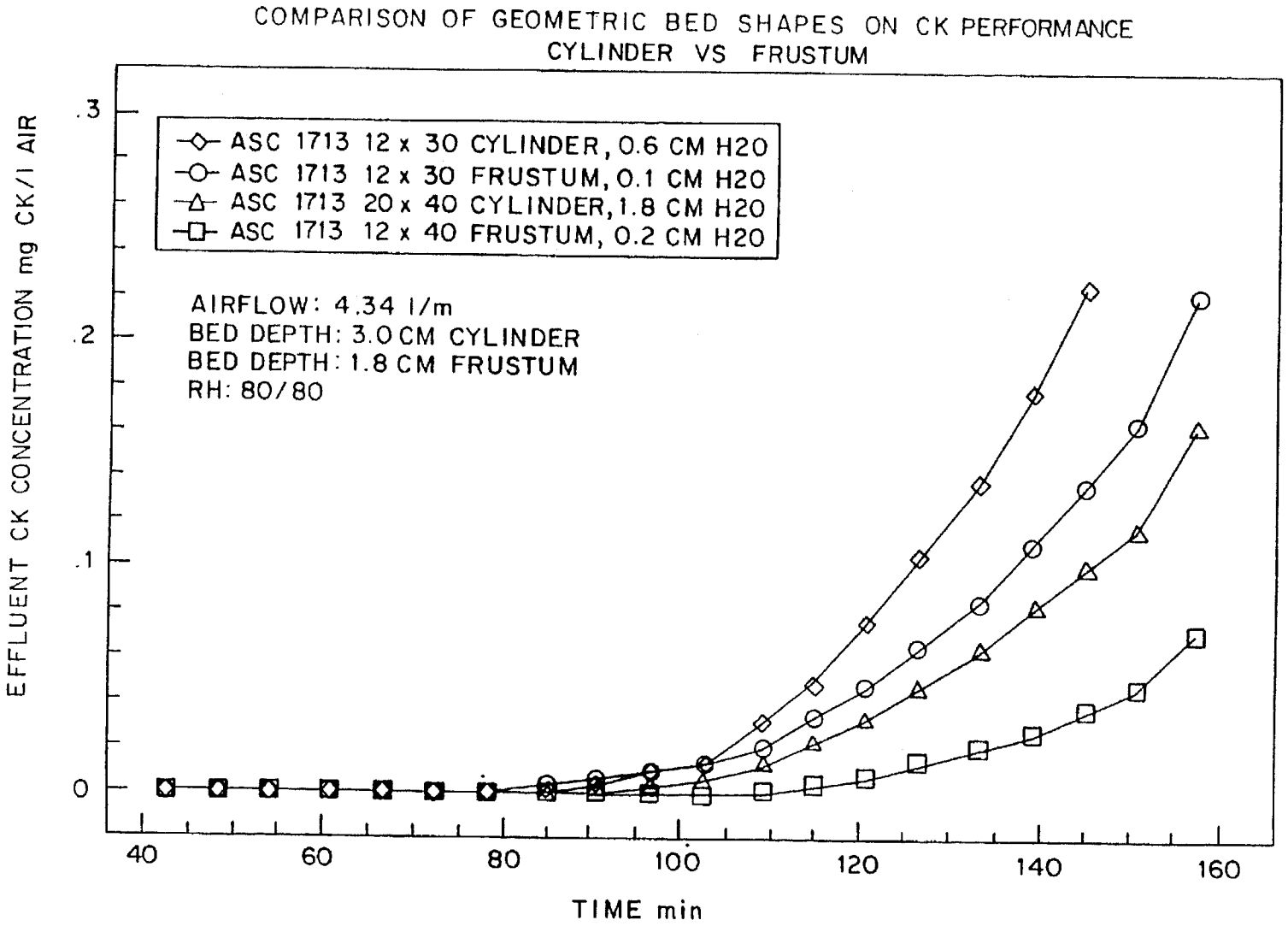
FIG. 3 is a graph of breakthrough curves for cylinder and frustum geometries.
Figure 4:
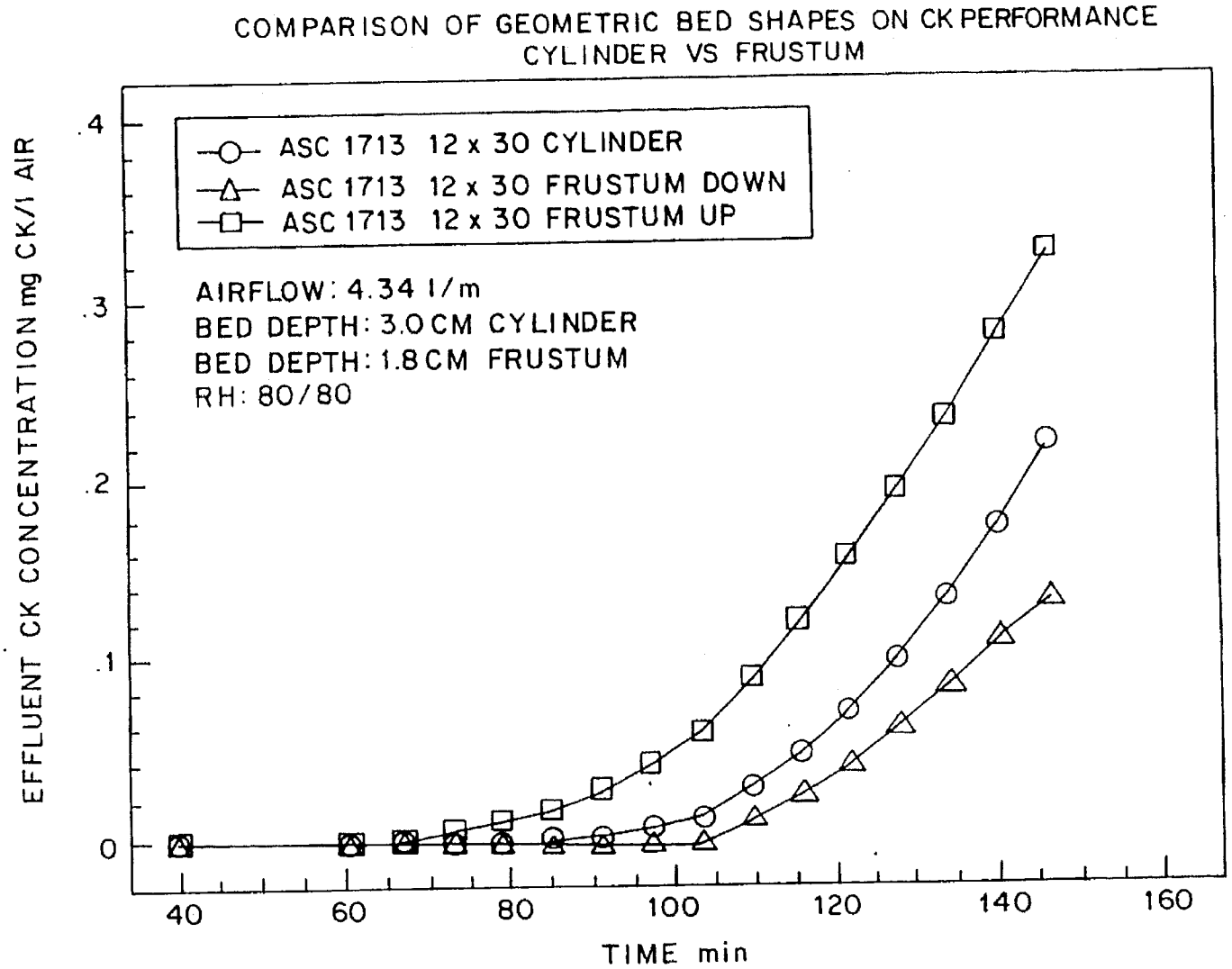
FIG. 4 is another graph of breakthrough curves for cylindrical and frustum geometries.

FIG. 3 shows the breakthrough curves for the two bed geometries and carbon sizes. In FIGS. 3 and 4 the lines drawn between the data points are not model predictions. Clearly the increased performance of the frustum over that of the cylinder is not merely a phenomenon that only occurs at low breakthrough concentrations. At all points along the break curve the frustum allows less cyanogen chloride through the carbon bed. Hence, for CK the frustum shaped carbon bed would not have to be changed as often and thus would be more economical.

(b) Particle layering in the carbon bed:

Particle layering, where larger particles are oriented upstream of the smaller particles, has been discovered to both lower pressure drop, and increase the protection time, compared to non-layered carbon beds. The separation of a wide mix of particles into two lots of particles, each with a more homogeneous size, results in a lower pressure drop. Packing density increases as the particle size distribution becomes wider or more heterogeneous. Smaller particles tend to fill in the gaps between the larger size particles, thus, increasing the packing density, and increasing the pressure drop. Hence, particles of the same size have a lower packing density and a lower pressure drop, for a given flow, than particles with a wider size distribution.

In the new canister and respirator design, the influent, or upstream side, of the carbon bed will have carbon particles U.S. sieve 12×18 (1.68–1.00 millimeters) in size. The effluent or downstream side of the bed, should have U.S. sieve 20×30 (0.841–0.595) size particles. It is imperative that the larger particles be situated upstream of the smaller particles.

(c) Dimpled inner wall:

A non-smooth, or dimpled, interior surface of the canister or respirator will provide a greater packing density at the wall/particle interface. The dimples should be approximately the size of the carbon particles. An irregular surface, on the wall of the carbon bed, gives a more homogeneous and greater packing density in the bed, than a smooth surface. As discussed in a paper by C. E. Schwartz and J. M. Smith titled "Flow Distribution in Packed Beds" from the Industrial and Engineering Chemistry journal, vol. 45, no. 6, June, 1953, the velocity profile for gases flowing through a packed bed is not flat and has a maximum 1 particle diameter from the bed wall. This is the "wall effect" discussed in the literature cited. The divergence of the velocity profile is less than 20% for ratios of bed to particle diameters of more than 30, the range for most gas mask canisters. This is still enough to promote a premature breakthrough of chemical agents through the carbon bed of a canister or hazardous chemicals through a respirator. A paper by Y. Cohen and A. B. Metzher titled "Wall Effects in Laminar Flow of Fluids Through Packed Beds", American Institute of Chemical Engineers Journal, vol. 27, no. 5, September, 1981, goes further and states that the "wall effect" extends to about 6 particle diameters from the bed wall. Both of the above articles explain the wall effect rigorously.

Empirical evidence of the "wall effect" was observed in work done at the Edgewood Research Development and Engineering Center, Edgewood, Md. Canisters from Canada were having earlier than expected breakthroughs when challenged with the physically adsorbed nerve agent simulent, dimethylmethyphosphonate (DMMP) vapor. A Computer Aided Tomgraphy (CAT) scan performed by Johns Hopkins University revealed increased penetration of DMMP vapor along the canister wall relative to the penetration of DMMP through the remainder of the bed. A lower packing density at the bed wall increased the velocity of the airstream along the canister wall and promoted the premature breakthrough of DMMP vapor. The dimpled walls should correct this problem in canisters and respirators.

(d) Carbon particles shaped as a hollow rectangular or cylindrical extrudate:

The carbon particles should have the maximum external surface area to volume ratio. This increases the external mass transfer rate of the adsorbate to the adsorbent. For protection against chemical agents and hazardous compounds, the greatest external mass transfer rate is desirable.

The term "a" is used by Ruthyen in his book "Principals of Adsorption and Adsorption Processes" and R. Yang in "Gas Separation by Adsorption Processes." It accounts for the external surface area per unit volume in mathematical models describing the mass transfer resistances in adsorbent particles. In the models the larger the values of "a" the greater the mass transfer rate of the adsorbent to the adsorbate.

A hollow rectangular or cylindrical (i.e. tube shaped) extrudate, where the particle size is between U.S. sieve #14 and U.S. #16 (1.41–1.19 millimeters) has a surface area to volume ratio of approximately 9.5. The same ratio for spherically shaped particles is 4.8. This is nearly a 100% increase in external surface area for the hollow rectangularly or cylindrically shaped particle will increase the external mass transfer rate, and thus, increase the protection time against toxic agents or noxious compounds.

This is especially true for adsorbents made from the partially anaerobic pyrolyzation of synthetic carbonaceous resins. These adsorbents are generally spherical in shape (e.g. Rohm and Haas Company commercial trademarked product XE348) with discreet pore size distributions. They are most commonly used as specialized adsorbents where frequently, the compound to be adsorbed is known. An application of these type of adsorbents is in industrial respirators and chemical protective suits. Industrial operations and hazardous waste sites often emit organic compounds. These compounds are usually known or can readily identified and a suitable hollow rectangular or cylindrical adsorbent can then be tailored for use as the adsorbent in the respirator.

The Leva equation shows the mathematical relationships among the various parameters affecting the pressure drop across a packed bed. The denominator contains the sphericity factor 0. It is defined as the ratio of the surface area of a sphere having the same volume as the particle to the actual surface area of the particle.

$$0=Vp/SpDp$$

where: Vp is the volume of the particle

Sp is the surface area of the particle

Dp is the diameter of the particle

By definition a sphere has a sphericity of 1. The value for granular carbon, according to Perry's Chemical Engineers' Handbook, McGraw-Hill 1984, page 5–54, is 0.73. The sphericity of the proposed hollow rectangular or cylindrical carbon particles is 0.51. According to the Leva equation the sphericity factor, located in the denominator, is raised to the 3–n power, where n is 1 in accordance with the modified Reynolds number for laminar flow which is characteristic of canisters. This would give values of 0.53 and 0.26, respectively for the sphericity squared of the granular and hollow particles. All other parameters remaining constant, the hollow rectangular of cylindrical carbon particles should, theoretically, have approximately twice the pressure drop as granular carbon, for a given air flow velocity.

However, this appears to be contradicted by a drag coefficient versus Reynolds number graph on page 5–62 of Perry's Chemical Engineers' Handbook, 1973. The graph shows the drag coefficient for a single cylinder to be less than a sphere for Reynolds numbers less than 50. The Reynolds numbers for the particle sizes and velocities of the invention are less than 10 where, according to the graph, cylinders have less of a drag coefficient than spheres. The calculated Reynolds numbers are shown below.

Particle Reynolds Numbers

NRe=(superficial velocity) (air density) (particle diameter) viscosity of air

Where: NRe=Reynolds number
viscosity of air=0.000175 Poise @20 C
density of air=1.1925 grams/liter @20 C 760 mmHg
velocity of air @32 lpm=9.6 cm/sec inlet 4.0 cm/sec outlet

| | | Reynolds number | |
|---|---|---|---|
| U.S. sieve size | average diameter | 9.6 cm/sec | 4.0 cm/sec |
| 8 × 12 | 0.203 cm | 13.2 | 5.5 |
| 12 × 18 | 0.134 cm | 8.8 | 3.7 |
| 18 × 20 | 0.092 cm | 6.0 | 2.5 |
| 20 × 30 | 0.072 cm | 4.7 | 2.0 |
| 40 × 60 | 0.034 cm | 2.2 | 0.9 |

Hence, for improved mass transfer, using a particle with the greatest surface area to volume ratio is important and well documented. However, for lower breathing resistance, the importance of using the lowest surface area to volume ratio is unclear and perhaps of less significant concern.

(e) Chromium free carbon.

Chromium is one of the impregnants in ASC (copper, silver and chromium) carbon formulations. This is the type of carbon commonly used in most canisters. The hexavalent chromium impregnant is a suspected carcinogen, it is found in the dust coming off the effluent side of canisters using ASC carbon, especially after rough handling. Hexavalent chromium is also defined as a hazardous waste, which increases its disposal costs significantly.

The Calgon Corporation has eliminated the chromium from their new ASZM-T (copper, silver, zinc, and molybdenum with triethylenediamine) or Cooperite (trademark) carbon impregnation formulation. The ASZM-T carbon provides balanced protection against all exposure to a wide variety of environmental conditions causes no dramatic changes in performance. A paper by D. T. Doughty of the Calgon Corporation, Pittsburg, Pa. titled "Development of a Chromium-Free Impregnated Carbon for Adsorption of Toxic Agents" CRDEC-CR-118 (Edgewood, Maryland) documents the development of a chromium free carbon.

Replacing the ASC (copper, silver, chromium) carbon with ASZM-T will lower the health risk to the user of the canister. An ASZM-T carbon filled canister will not have the degradation in performance, particularly against the blood agents hydrocyanic acid and cyanogen chloride, after exposure to humid air that ASC carbon filled canisters experience.

Depending on the requirements of the user, many of the parameters called for could be varied. The relative importance of pressure drop and protection time will have a direct bearing on the exact specifications. Parameters including carbon bed volume, particle size, particle ratio (i.e. mix of small versus large particles), particle shape, selection of particular adsorbent (i.e. coal based carbon, pyrolyzed resin), and ratio of inlet and outlet diameters of the carbon bed, could be varied to suit the specification of the user.

Inasmuch as the present invention is subject to many variations, modifications and changes in detail, it is intended that all matter contained in the forgoing description or shown in the accompanying drawings shall be interpreted as illustrative and not in a limiting sense.

What is claimed is:

1. A filtration system for removing undesirable constituents from a fluid comprising:

housing means defining a fluid filtration chamber and including upstream port means for passing fluid to be filtered into said filtration chamber and downstream port means for passing filtered fluid from said filtration chamber;

first filter means within said filtration chamber including a packed array of substantially similar sized filter particles forming a filter bed;

second filter means within said filtration chamber positioned downstream of said first filter means including another packed array of substantially similar sized filter particles forming a filter bed;

the filter particles in said second filter means having a smaller size than the filter particles in said first filter means; and said housing means including inner wall means having a dimpled surface abutting said filter particles of said first filter means and including dimples sized to approximately correspond to the size of the filter particles of said first filter means, and having a dimpled surface abutting said filter particles of said second filter means and including dimples sized to approximately correspond to the size of the filter particles of said second filter means.

2. The filtration system of claim 1 wherein:

said first filter means is configured to expose a greater cross section area of filter particles to the fluid to be filtered at an upstream section thereof and a smaller cross section area of filter particles to the fluid to be filtered at a downstream section thereof.

3. The filtration system of claim 2 wherein:

said second filter means is configured to expose a greater cross section area of filter particles to the fluid to be filtered at an upstream section thereof and a smaller cross section area of filter particles to the fluid to be filtered at a downstream section thereof.

4. The filtration system of claim 3 wherein:

said inner wall means has a frustum configuration which abutably surrounds said first and second filter means.

5. The filtration system of claim 4 wherein:

said upstream port means includes a baffle extending thereacross; and said downstream port means is a cylindrical boss having coupling means for connection to a user device such as a gas mask.

6. The filtration system of claim 5 and further including:

a particulate filter in said fluid filtration chamber positioned upstream of the first filter means;

a screen interposed between said first and second filter means and having a mesh size small enough to substantially prevent the smaller filter particles of the second filter means from intermixing with the larger filter particles of the first filter means; and a dust screen interposed between said second filter means and said downstream port means.

7. The filtration system of claim 1 wherein:

said inner wall means has a frustum configuration which abutably surrounds said first and second filter means.

8. The filtration system of claim 1 wherein:

said filter particles of said first and second filter means are carbon particles.

9. The filtration system of claim 8 wherein:

said filter particles of said first and second filter means are tubular cylinders having a hollow core therethrough.

10. The filtration system of claim 8 wherein:

said filter particles are chromium-free carbon particles.

* * * * *